US007316319B2

(12) United States Patent
West

(10) Patent No.: US 7,316,319 B2
(45) Date of Patent: Jan. 8, 2008

(54) LIFT VAN SYSTEM

(76) Inventor: Thomas West, 212 Locust Grove Rd., Greenfield Center, NY (US) 12833

( * ) Notice: Subject to any disclaimer, the term of this patent is extended or adjusted under 35 U.S.C. 154(b) by 233 days.

(21) Appl. No.: 11/017,955

(22) Filed: Dec. 21, 2004

(65) Prior Publication Data

US 2005/0132936 A1 Jun. 23, 2005

Related U.S. Application Data

(60) Provisional application No. 60/532,293, filed on Dec. 23, 2003.

(51) Int. Cl.
*B65D 19/00* (2006.01)

(52) U.S. Cl. ..... 206/596; 206/386; 206/600; 108/51.3

(58) Field of Classification Search ..... 229/125.19, 229/125.26, 125.28, 125.32; 206/386, 596, 206/597, 600; 220/1.5; 108/51.3, 55.1, 108/57.33
See application file for complete search history.

(56) References Cited

U.S. PATENT DOCUMENTS 2,454,455 A * 11/1948 Irwin ..... 206/265
2,963,210 A * 12/1960 Gillmore, Sr. ..... 229/178
3,677,201 A * 7/1972 Chadbourne ..... 108/57.33
4,019,634 A * 4/1977 Bonnot ..... 206/597
4,069,938 A * 1/1978 Palte et al. ..... 217/13
4,085,847 A * 4/1978 Jacalone ..... 206/600
4,424,753 A * 1/1984 Eatherton ..... 108/57.33
5,139,194 A * 8/1992 Youell, Jr. ..... 229/122.27
5,170,933 A * 12/1992 Perry ..... 229/122.3
6,041,718 A * 3/2000 Brandes et al. ..... 108/51.3
6,050,410 A * 4/2000 Quirion ..... 206/386
6,070,726 A * 6/2000 Graham ..... 206/386
6,581,769 B2 * 6/2003 Nist ..... 206/386

* cited by examiner

*Primary Examiner*—David Fidei
(74) *Attorney, Agent, or Firm*—Hoffman, Warnick & D'Alessandro LLC

(57) ABSTRACT

A lift van system that includes: a top and bottom cap, each comprising a folded sheet, wherein each folded sheet has substantially similar design specifications; first and second side wall sections, each comprising a single sheet, wherein the first and second side wall sections have substantially similar design specifications; and a cardboard pallet, wherein the pallet fits into the bottom cap.

21 Claims, 9 Drawing Sheets

LIFT VAN SYSTEM

CLAIM OF PRIORITY

The present invention claims priority to U.S. Provisional Application Ser. No. 60/532,293 filed on Dec. 23, 2003, entitled "CARDBOARD LIFT VAN SYSTEM."

BACKGROUND OF THE INVENTION

1. Technical Field

The present invention relates generally to packaging and containers, and relates more specifically to a corrugated fiberboard lift van system.

2. Related Art

Lift vans are widely utilized in the moving and transportation industries as containers for storage, packaging, and transport. Lift vans provide a relatively large uniform sized container in which items can be easily stored and moved. Typical dimensions are, e.g., 88" in length×45" in width×88" in height. Because of their uniform dimensions, the containers can be easily placed on pallets (or incorporate a pallet) that allow the container to be moved with a forklift.

Most prior art lift vans are constructed from plywood. Accordingly, constructing, packaging and moving the lift vans involve costly operations. Also, some countries are beginning to place restrictions on the import of plywood due to environmental issues involving bugs and the like infesting the wood.

One solution to the problem involves utilizing cardboard or fiberboard instead of plywood. Unfortunately, significant complexity is introduced in designing a cardboard/fiberboard lift van due to the fact that the container must provide significant structural resiliency. To address this, prior art cardboard lift vans require many different cardboard/fiberboard parts that are expensive and complicated to manufacture. Assembly of the prior art designs is also complicated given the many parts involved in constructing such a large containment device. In addition, the cardboard/fiberboard lift van must be collapsible so that it can be broken down for storage when not in use. Accordingly, a need exists for a simple to manufacture and assemble lift van system.

SUMMARY OF THE INVENTION

The present invention addresses the above-mentioned problem, as well as others, by providing a lift van container that can manufactured from a small number of parts, and be easily collapsed or erected as needed.

In a first aspect, the invention provides a lift van system that includes: a top and bottom cap, each comprising a folded sheet, wherein each folded sheet has substantially similar design specifications; first and second side wall sections, each comprising a single sheet, wherein the first and second side wall sections have substantially similar design specifications; and a pallet, wherein the pallet sits within the bottom cap.

In a second aspect, the invention provides a lift van container, comprising: a top and bottom cap, each comprising a folded sheet of material, wherein both folded sheets have substantially similar design specifications; first and second side wall sections, each comprising a foldable sheet of material, wherein the first and second side wall sections have substantially similar design specifications; and a pallet, wherein the pallet can be snapped into a lip of the bottom cap.

In a third aspect, the invention provides a container, comprising: a top and bottom cap, each comprising a folded sheet of material, wherein both folded sheets have substantially similar design specifications; and first and second side wall sections, each comprising a foldable sheet of material that forms three walls when erected, wherein the first and second side wall sections have substantially similar design specifications.

DETAILED DESCRIPTION OF THE INVENTION

Figure 1:
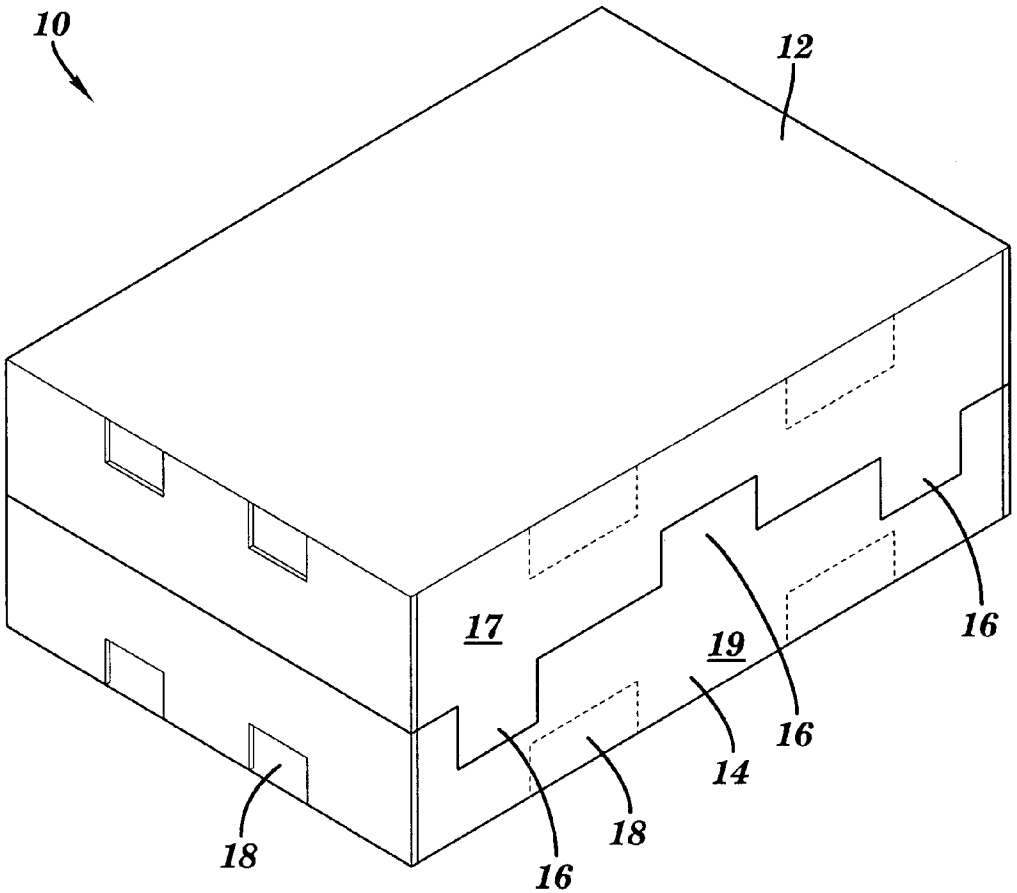
FIG. 1 depicts an isometric view of a lift van container in a collapsed position in accordance with the present invention.
Figure 4:
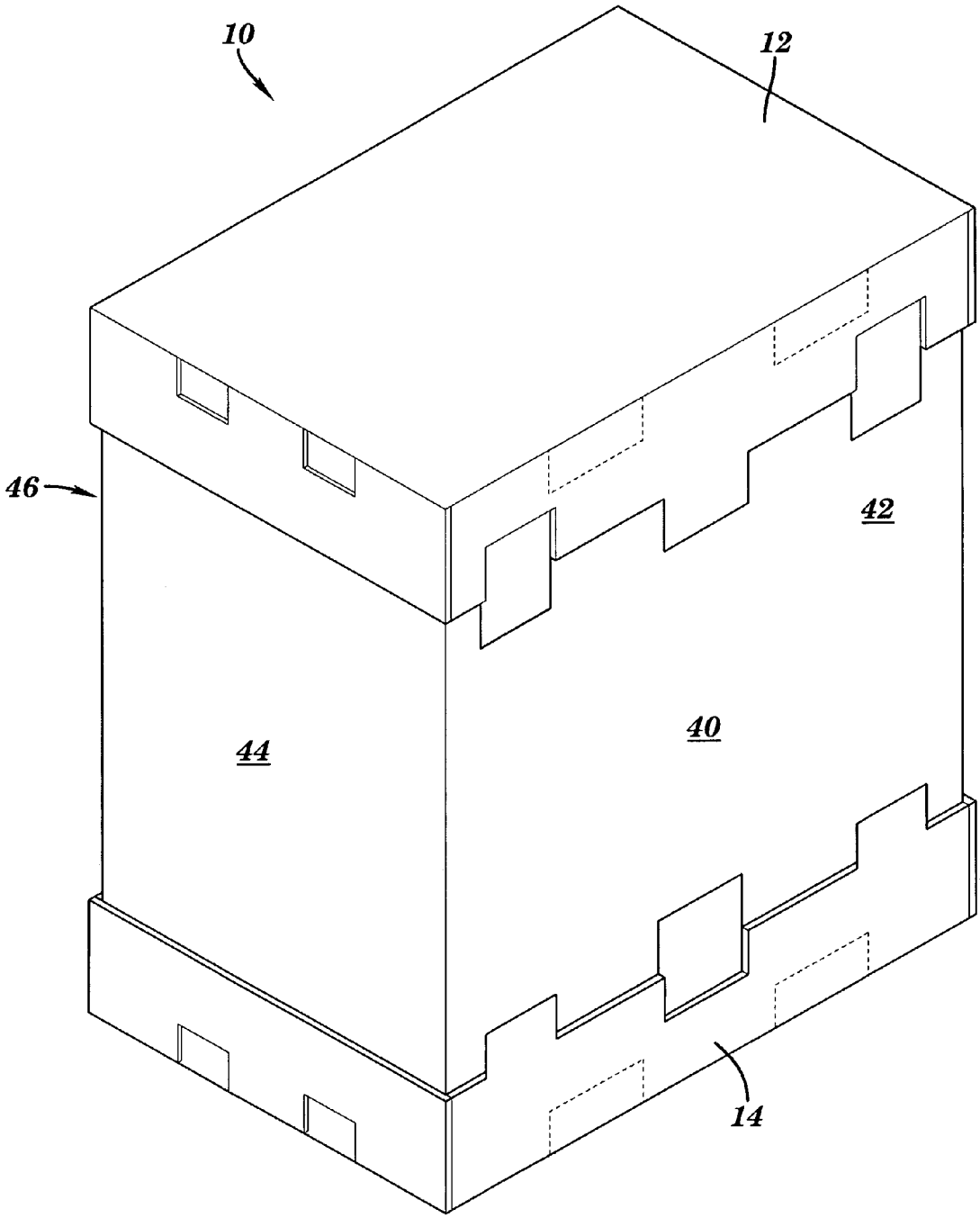
FIG. 4 depicts an isometric view of an erected lift van system in an erected position in accordance with the present invention.

FIG. 1 depicts an isometric view of a lift van container 10 ("container 10") in a broken down or collapsed position, suitable for storage and transport before being erected and loaded with wares. FIG. 4, described below, depicts the container 10 in its erected position, suitable for holding wares. In the collapsed position, container 10 is completely packaged within a top cap 12 and a bottom cap 14. Enclosed with the top cap 12 and bottom cap 14 are a pallet 20 (described below) and side wall sections 30, 40 (also described below).

Figure 5:
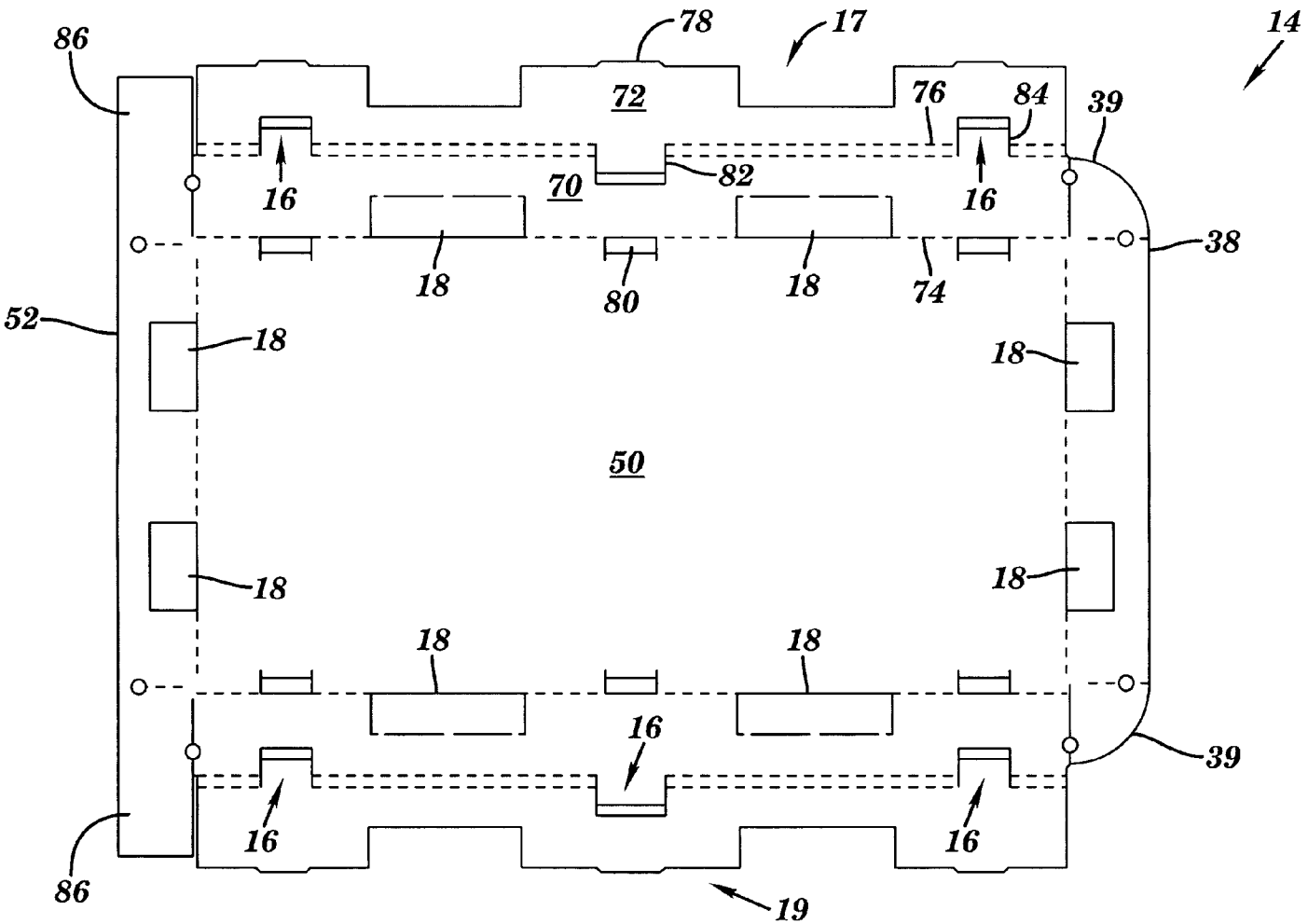
FIG. 5 is design schematic of a top and bottom cap.
Figure 9:
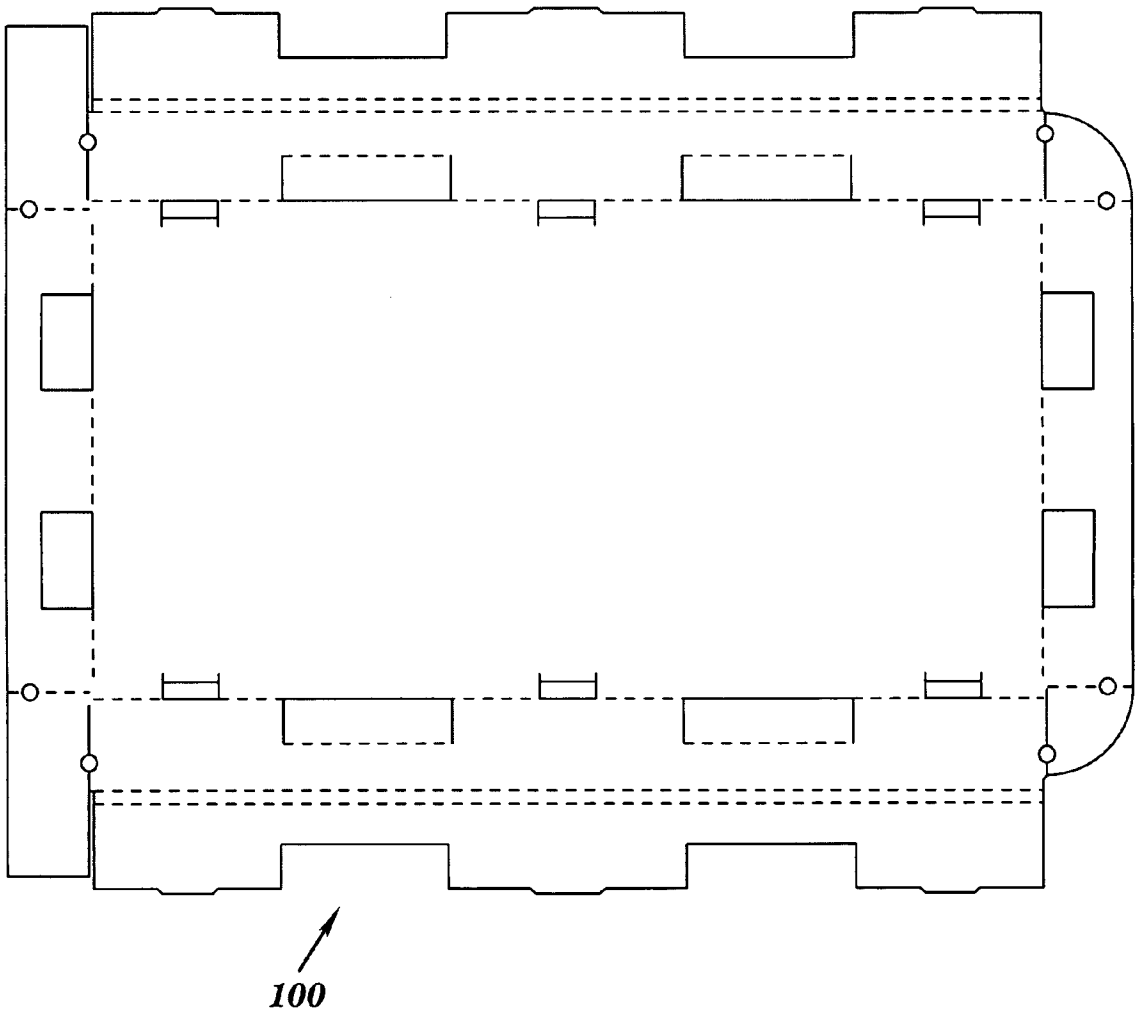
FIG. 9 is an alternative design schematic of a top and bottom cap.

Both of the top and bottom caps 12 and 14 are identical in that they are created from the same (or substantially the same) dye/design specifications, i.e., they are produced from identical (or substantially identical) cut sheets, e.g., cardboard, fiberboard, etc. FIG. 5, described below, depicts a design schematic of the top and bottom cap 12, 14. FIG. 9 depicts an alternative embodiment of a top and bottom cap. Because the top and bottom share the same specifications, the complexity of the manufacturing process is greatly reduced.

As shown in FIG. 1, both the top and bottom caps 12, 14 have interlocking tabs 16 that allow the container 10 to be securely packaged in the collapsed position. In particular, each of the top and bottom caps 12, 14 has a first side flap 17 with two exterior tabs and one interior tab, and a second side flap 19 with one exterior tab and two interior tabs (the tab features are described in further detail in FIG. 5). When a first side flap 17 of the bottom cap 14 is mated with a second side flap 19 of the top cap 12 as shown, the exterior tabs interlock with the interior tabs, thereby securing the top cap 12 to the bottom cap 14. The alterative embodiment shown in FIG. 9 does not include interlocking tabs 16.

Each cap also includes a plurality of forklift holes 18 that allow the container 10 to be lifted and moved from any of the four sides with a standard forklift. The forklift holes 18 are accessible in both the collapsed and erected positions.

Figure 2:
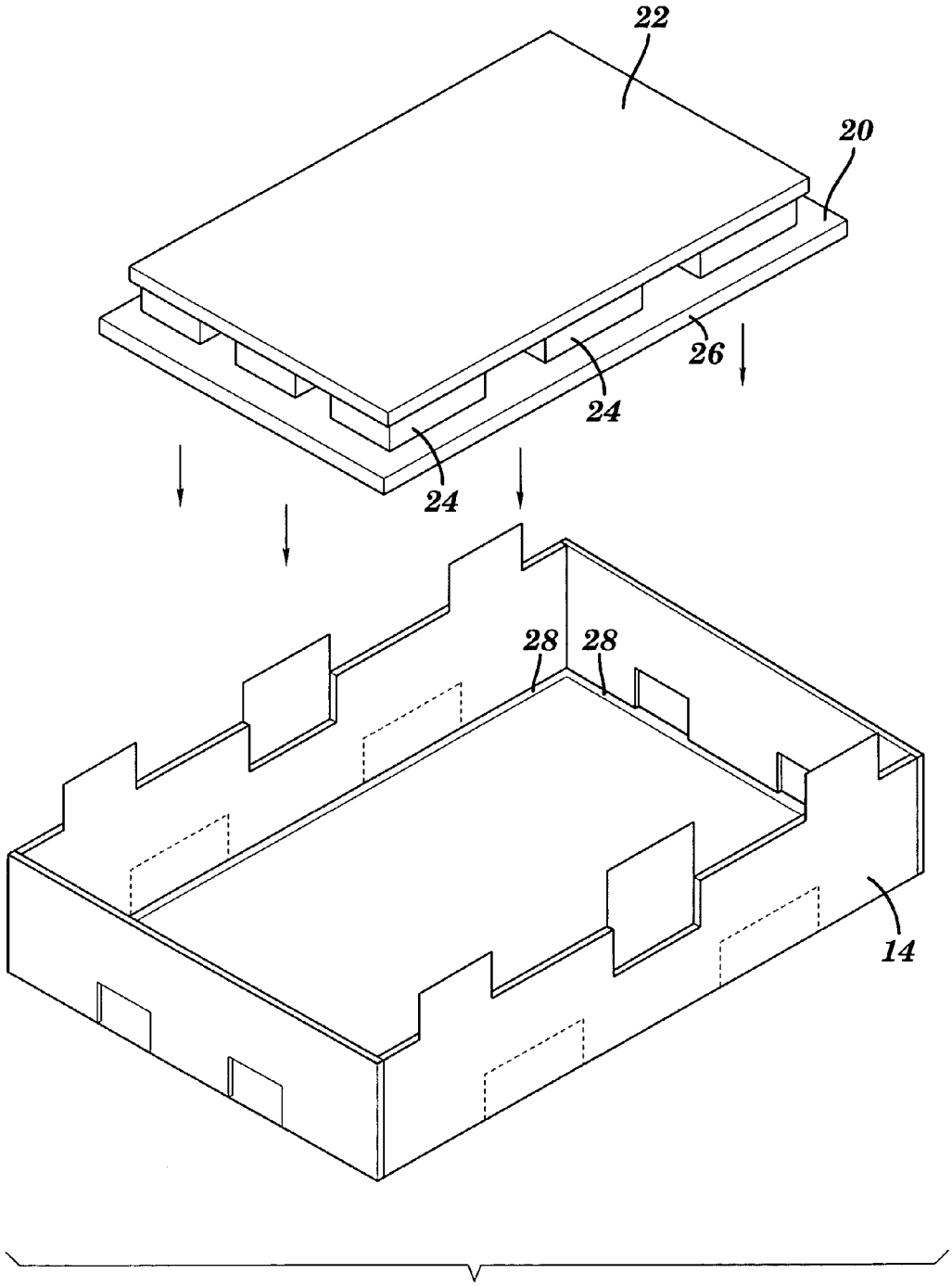
FIG. 2 depicts an isometric view of a bottom of the lift van container of FIG. 1 with the pallet being installed.
Figure 7:
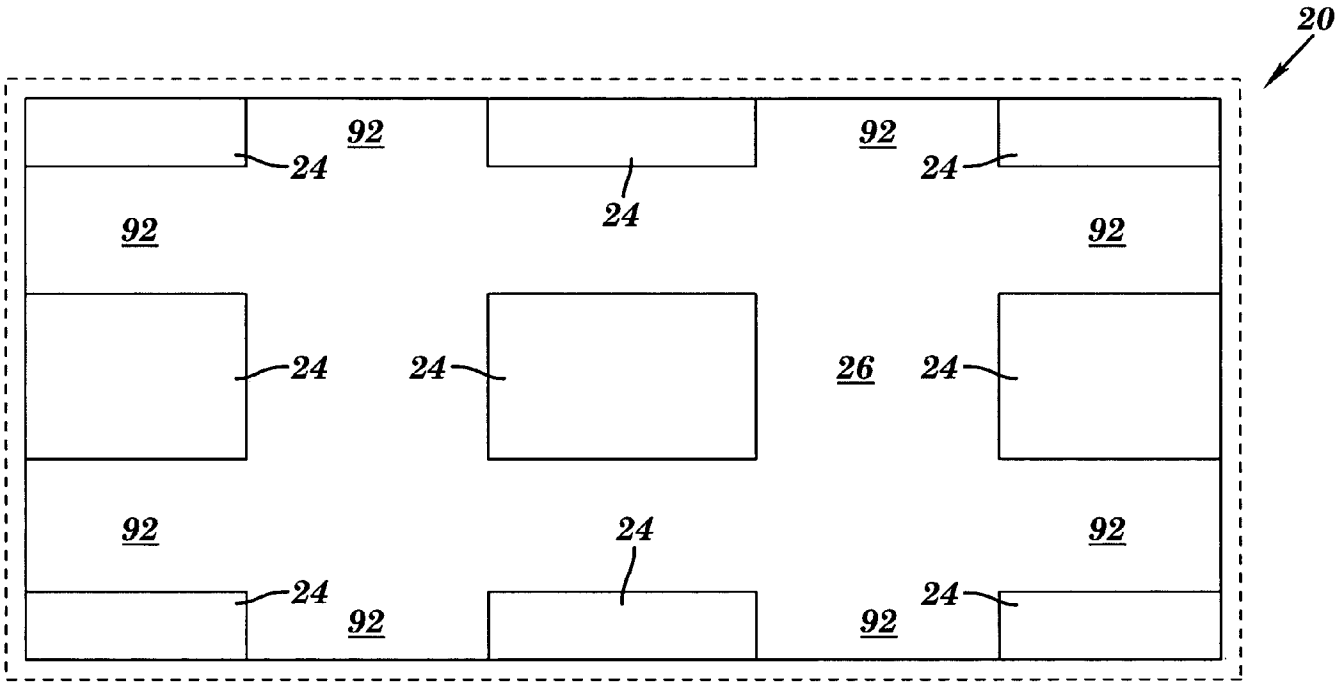
FIG. 7 is a design schematic of a pallet design.

FIG. 2 depicts an isometric view of the bottom cap 14 of the lift van container 10 with a pallet 20 being installed. Pallet 20 is comprised of a pallet surface 22, a plurality of bocks 24, and a bottom floor 26. Defined within the entire inside bottom edge of the bottom cap 14 is a lip 28 for receiving the bottom floor 26. The bottom floor 26 of the pallet 20 is sized to fit securely into an edge 28 of the bottom cap, and thus, obviate the need for any additional parts to secure the pallet. It should be noted any system for receiving and securing pallet 20 in bottom cap 14 could be utilized. FIG. 7, described below, depicts a design schematic of the pallet 20.

Figure 3:
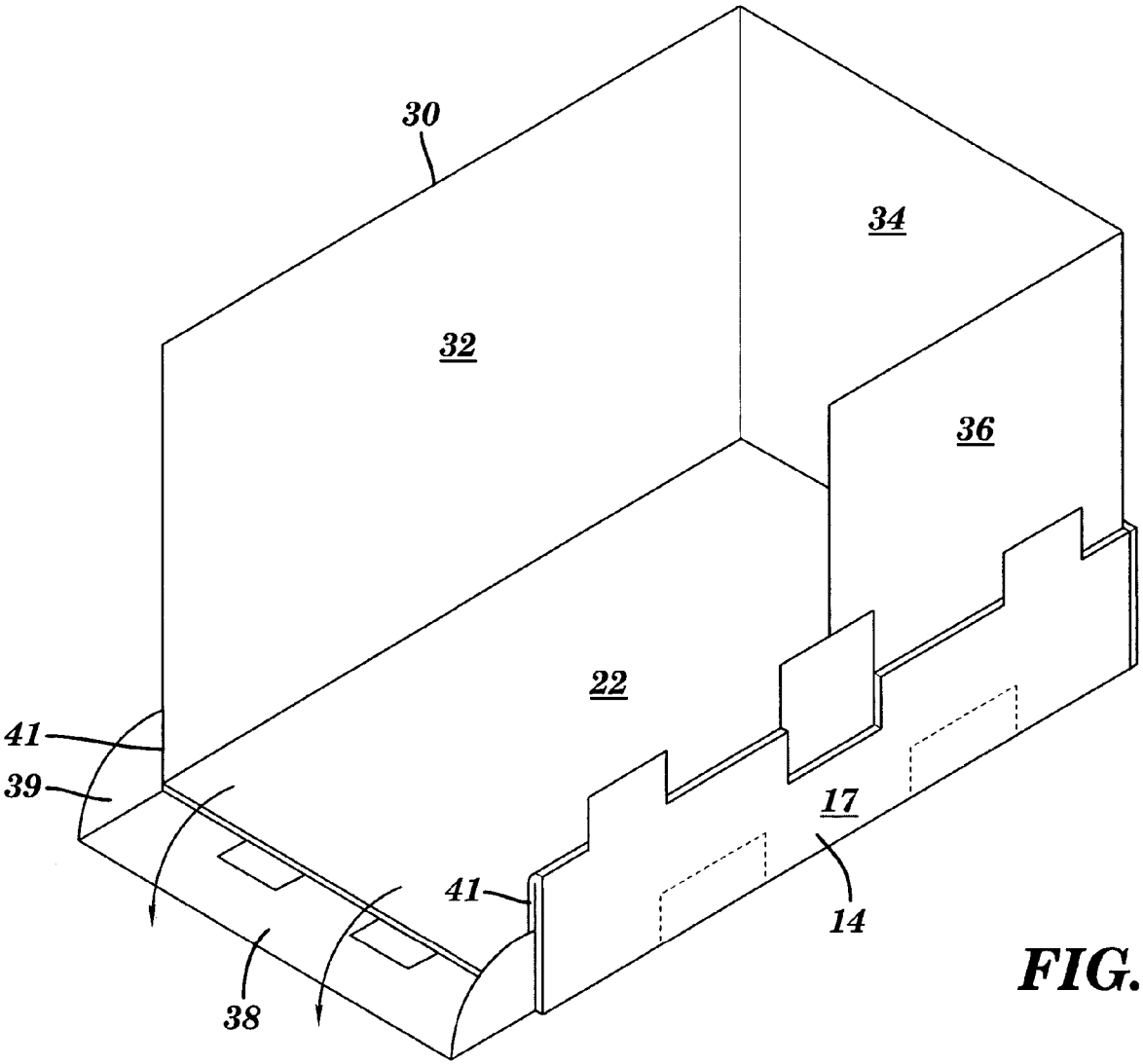
FIG. 3 depicts an isometric view of a bottom of the lift van container of FIG. 1 with a first part of a sidewall installed and an end flap folded down for loading.
Figure 6:
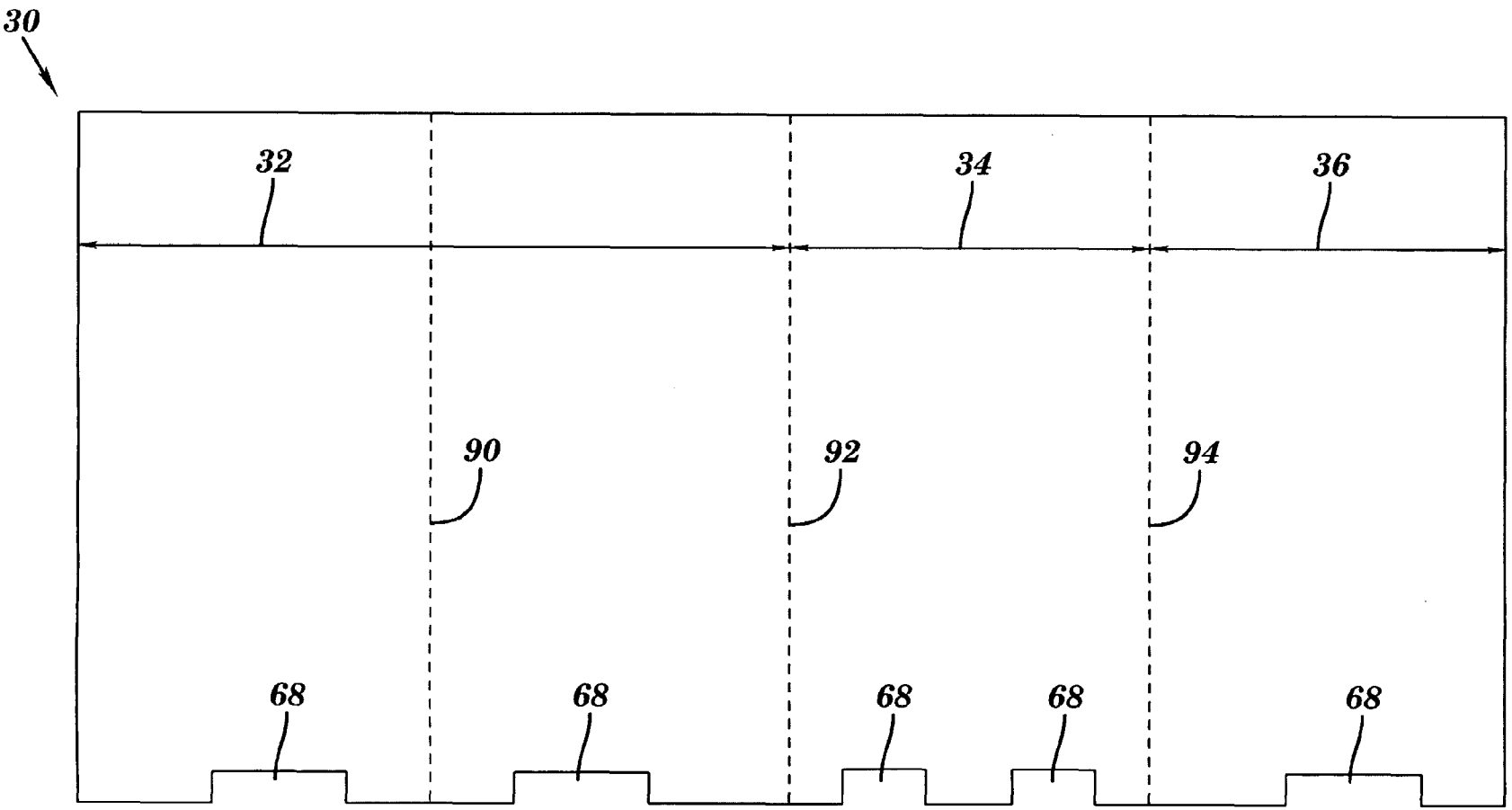
FIG. 6 is a design schematic of a sidewall part.
Figure 10:
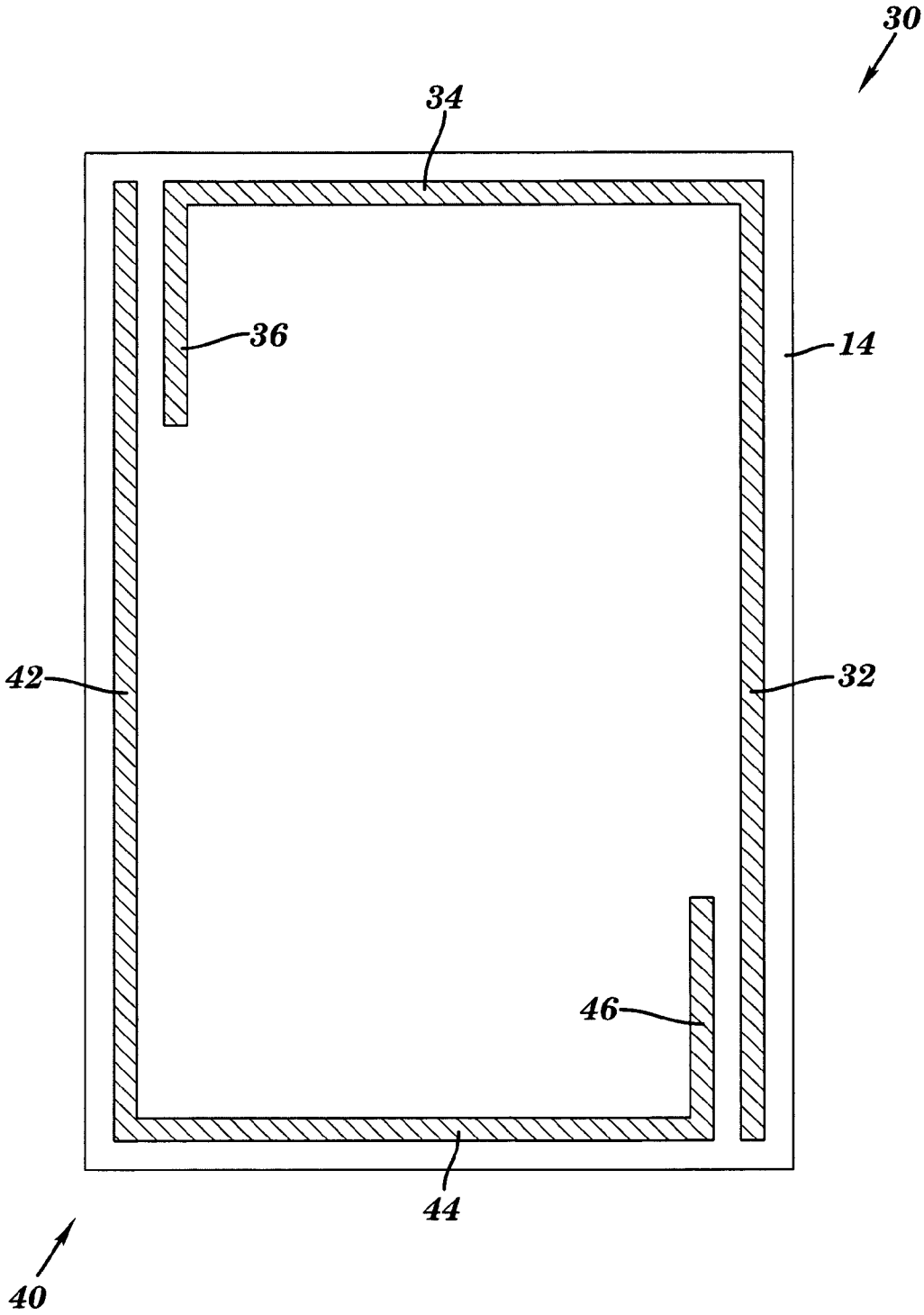
FIG. 10 is a top cross-sectional view of the sidewall sections of the container.

FIG. 3 depicts an isometric view of the container 10 with a first sidewall section 30 installed. First sidewall section 30 includes three segments 32, 34, and 36 that form two full walls (segments 32 and 34) and a partial wall (segment 36). A second sidewall section 40 (not shown), of the same design specifications as the first sidewall section 30 is placed opposite the first sidewall section 30 and overlaps with segments 32 and 36 to form the remain walls of the container. FIG. 6, described below, depicts a design schematic of side wall sections 30. FIG. 10 depicts a cross-sectional top view of both wall sections 30 and 40.

As also shown in FIG. 3, bottom cap 14 includes a fold down end flap 38 that allows a first side edge of the bottom cap 14 to be folded down into an open position for loading/unloading. Fold down end flap 38 includes rounded edges 39 that pivot in and out of folds 41 formed between layers that make up side flaps 17 and 19 (19 not shown) of the bottom cap 14. The configuration shown in FIG. 3 would be typical for loading and unloading the container 10. Once the loading/unloading process is complete, fold down end flap 38 can be secured back into folds 41 of the bottom cap 14. Note that no additional parts are required to open and/or secure the fold down end flap 38.

FIG. 4 depicts an isometric view of an erected lift van container 10 having both sidewall sections 30 and 40 installed and the top cap 12 placed thereon. Note that the sidewall sections 30, 40 overlap with each other, such that only side wall section 40 is visible in the view shown. As noted above, both sidewall sections 30, 40 comprise the same design specifications—i.e., they are interchangeable and thus comprise the same (or substantially the same) part. Second side wall section 40 includes three segments 42, 44, 46 (46 not visible in this view). FIG. 10 shows a cross-sectional top view of the first and second side wall sections 30, 40.

Referring now to FIG. 5, a design schematic of bottom cap 14 ("cap 14") is shown. (As noted above, top cap 12 is identical to bottom cap 14.) Cap 14 include a flat surface 50, opposed side flaps 17 and 19, a fold down end flap 38, and a fixed end flap 52. As described above, fold down end flap 38 includes rounded edges 39 that allows fold down end flap 38 to be pivoted into and out of folds 41 (formed when side flaps are folded as described below). Opposed side flaps 17, 19 each comprise an interior and exterior layer folded together. In particular, side flap 17 includes an exterior section 70, an interior section 72, an inner fold line 74 and an outer "double" fold line 76. Interior section 72 can be folded inwardly along the outer "double" fold line 76 to mate with the exterior section 70, both of which can then be folded inwardly perpendicular to the surface 50 to form side flap 17. Interior section 72 includes a plurality of locking tabs 78 that lock into receiving holes 80 to secure the flap in position. Side flap 19 is constructed in a similar fashion.

When constructed, side flaps 17, 19 form folds 41 (shown in FIG. 3) that receive the rounded edges 39 of the fold down end flap 38 at one end, and fixed edges 86 of the fixed end flap 52 at the other end.

As can be seen, interlocking tabs 16 are cut into the side flaps 17, 19. The tabs that extend from the interior section 72 form interior tabs (e.g., 82), and the tabs that extend from the exterior section form exterior tabs (e.g., 84). Fork lift holes 18, as described above, are also provided. As noted, FIG. 9 depicts an alternative embodiment of a cap 100, which is substantially similar to that shown in FIG. 5, except that it does not include interlocking tabs 16.

Referring now to FIG. 6, a schematic diagram of side wall section 30 is shown, which forms three wall segments 32, 34, and 36, described above in FIG. 3. Side wall section 30 includes three folds 90, 92 and 94, which allow the side wall section 30 to be folded for storage in the collapsed position within top cap 12 and bottom cap 14 (FIG. 1). Folds 92 and 94 are used to fold the wall section 30 when erected (FIGS. 3 and 4). Fold 92 may be reverse scored, allowing the sidewall section 30 to be folded in both directions. Side wall section 30 also includes fork lift cutouts 68 that match up with the forklift cutouts 18 in the bottom cap 14. As noted above, both side wall sections 30 and 40 are interchangeable.

Figure 8:
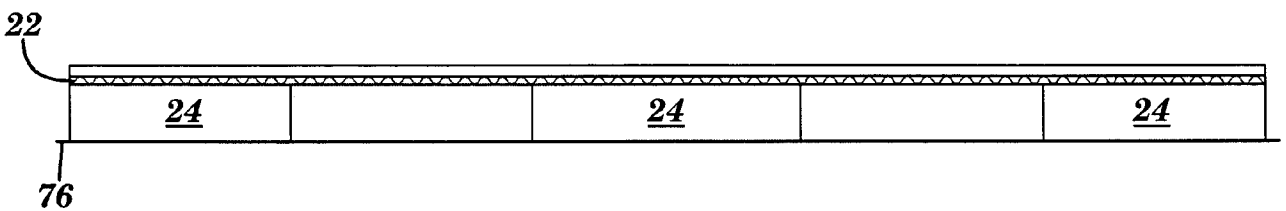
FIG. 8 is a side view of the design schematic of FIG. 7.

Referring now to FIGS. 7 and 8, pallet 20 is shown, which comprises a bottom floor 26, a plurality of blocks 24, and a pallet surface 22 (FIG. 8). Blocks 24 are spaced to form openings 92 to provide a four way entry for a fork lift device. Blocks 24 may be formed from any type of structure, e.g., corrugated layers, etc. Pallet floor 22 may be comprised from, e.g., a two-piece cross laminated/corrugated structure.

The foregoing description of the preferred embodiments of the invention has been presented for purposes of illustration and description. They are not intended to be exhaustive or to limit the invention to the precise form disclosed, and obviously many modifications and variations are possible in light of the above teachings. Such modifications and variations that are apparent to a person skilled in the art are intended to be included within the scope of this invention as defined by the accompanying claims.

It should be appreciated that the invention could be fabricated from any type of material, including, but not limited to cardboard, corrugated fiberboard, boards constructed from polymers, composites, plastics, foam, etc. Moreover, while the caps 12, 14 (as well as the side wall sections) are described as being identical, they need not be exactly the same, i.e., they could include some differences. However, as noted above, by maintaining the same design for both caps and both side wall sections, the manufacturing complexity and cost is reduced. In addition, while the embodiments described above are generally directed toward a lift van container system, the inventive features could be applied to any type of container of any dimension.

The invention claimed is:

1. A lift van system that includes:

a top and bottom cap, each comprising a folded sheet, wherein each folded sheet has substantially similar design specifications allowing interchangeability therebetween;

first and second side wall sections, each comprising a single sheet, wherein the first and second side wall sections have substantially similar design specifications allowing interchangeability therebetween; and a pallet, wherein the pallet sits within the bottom cap;

wherein the top and bottom caps and sidewall sections further comprise fork lift holes.

2. The lift van system of claim 1, wherein the top and bottom caps include tabs that interlock the top and bottom caps when the lift van system is in a collapsed position.

3. The lift van system of claim 1, wherein the bottom cap includes a drop down end flap.

4. The lift van system of claim 1, wherein the side wall sections and pallet can be stored in the top and bottom cap when the lift van system is in a collapsed position.

5. The lift van system of claim 1, wherein the first and second side wall sections overlap when the lift van system is in an erected position.

6. The lift van system of claim 1, wherein the pallet comprises a pallet surface, a plurality of blocks, and a bottom floor.

7. The lift van system of claim 1, wherein the lift van is comprised of corrugated fiberboard.

8. A lift van container, comprising:

a top and bottom cap, each comprising a folded sheet of material, wherein both folded sheets have substantially similar design specifications allowing interchangeability therebetween, wherein the bottom care includes a fold down end flap that can be folded downward relative to two adjacent side flaps;

first and second side wall sections, each comprising a foldable sheet of material, wherein the first and second side wall sections have substantially similar design specifications; and a pallet, wherein the pallet can be secured into the bottom cap.

9. The lift van container of claim 8, wherein the top and bottom caps include tabs that interlock the top and bottom caps when the container is in a collapsed position.

10. The lift van container of claim 8, wherein the drop down end flap is pivotally guided by the two adjacent side flaps.

11. The lift van container of claim 8, wherein the side wall sections and pallet can be stored in the top and bottom cap when the container is in a collapsed position.

12. The lift van container of claim 8, wherein the top and bottom caps and sidewall sections further comprise fork lift holes.

13. The lift van container of claim 8, wherein the first and second side wall sections overlap when the container is in an erected position.

14. The lift van container of claim 8, wherein the pallet comprises a pallet surface, a plurality of blocks, and a bottom floor.

15. The lift van container of claim 8, wherein the lift van container is comprised of a material selected from the group consisting of: cardboard, corrugated fiberboard and a polymer based material.

16. A container, comprising:

a top and bottom cap, each comprising a folded sheet of material, wherein both folded sheets have substantially similar design specifications allowing interchangeability therebetween; and first and second side wall sections, each comprising a foldable sheet of material that forms three walls when erected, wherein the first and second side wall sections have substantially similar design specifications;

wherein the top and bottom cans and sidewall sections further comprise fork lift holes.

17. The container of claim 16, wherein the top and bottom caps include tabs that interlock the top and bottom caps when the container is in a collapsed position.

18. The container of claim 16, wherein the bottom cap includes a drop down end flap.

19. The container of claim 16, wherein the side wall sections can be stored in the top and bottom cap when the container is in a collapsed position.

20. The container of claim 16, wherein the first and second side wall sections include three folds that allows each section to be collapsed into four sections for storage.

21. The container of claim 16, wherein the bottom cap includes a system for securing a pallet.

* * * * *